US005174412A

United States Patent [19]

Vega

[11] Patent Number: 5,174,412

[45] Date of Patent: Dec. 29, 1992

[54] LADDER LEVELER

[76] Inventor: Henry M. Vega, 101 Carriage Estates, Elmira, N.Y. 14904

[21] Appl. No.: 806,106

[22] Filed: Dec. 12, 1991

[51] Int. Cl.[5] ..... E06C 7/44

[52] U.S. Cl. ..... 182/204

[58] Field of Search ..... 182/200-205

[56] References Cited

U.S. PATENT DOCUMENTS 3,165,170 1/1965 Blaney ..... 182/203
3,447,631 11/1967 Smith .
3,474,883 8/1967 Weis .
3,484,814 5/1968 Meehan .
4,014,406 5/1976 Easton .
4,236,603 11/1978 Talley .
4,607,726 8/1986 Davis ..... 182/204
4,802,471 2/1988 Cardell .
4,852,689 1/1987 Erion .

FOREIGN PATENT DOCUMENTS 836612 6/1960 United Kingdom ..... 182/204

*Primary Examiner*—Alvin C. Chin-Shue
*Attorney, Agent, or Firm*—Ralph R. Barnard

[57] ABSTRACT

A simple ladder leveling device which slides onto either leg (8) of a ladder. The device is secured onto the ladder by sliding underneath and around rungs of the ladder. Furthermore, the ladder leveler includes a channel sleeve (3) with a slidable intrack leg (5) for adjusting the ladder leveler to the length desired; the intrack leg (5) is secured onto the channel sleeve (3) by an insertable holding pine (10) traversing the intrack leg (5) and the channel sleeve (3).

10 Claims, 1 Drawing Sheet

LADDER LEVELER

BACKGROUND OF INVENTION

1. Field of Invention

The present invention relates to ladder leveling devices. Specifically, this invention concerns a simple ladder leveler which slides onto either leg of a ladder, slides underneath and around rungs of said ladder, and is adjustable in length.

2. Description of the Related Art

Prior art teaches numerous devices for leveling ladders. Batten (U.S. Pat. No. 4,423,797), Meehan (U.S. Pat. No. 3,484,814), Talley (U.S. Pat. No. 4,236,603), Cordell (U.S. Pat. No. 4,802,471), Smith (U.S. Pat. No. 3,447,631), Easton (U.S. Pat. No. 4,014,406), and Erion (U.S. Pat. No. 4,852,689) are amongst the numerous patented leveling devices. Batten teaches a leveler guide secured onto a ladder leg and with a leveler leg fitting within the guide. The leveler guide and leveler leg have pin holes for the insertion of a pin in order to hold the leveler leg in fixed position relative to the leveler guide. Batten's device, however, is secured to said ladder leg by screws or clamps and is therefore not easily removed from the ladder leg. Furthermore, Batten's device is secured onto only one side of a ladder leg and therefore does not provide much resistance in case the ladder leans to the left or right.

Meehan teaches a ladder leveling device for connecting to a ladder leg of a ladder and having a mechanism for locking onto and unlocking off the ladder. Meehan's device, however, does not have an adjustable leveler leg. Also, Meehan like Batten is connected only to one side of a ladder leg and therefore does not provide much resistance in case the ladder leans to the left or right.

Talley teaches an adjustable ladder leveler which slides onto a leg of a ladder. A pin is inserted through a pin hole in the ladder leveler and a pin hole on the ladder leg. The Talley device requires the ladder leg to have pin holes; therefore, a ladder needs to be modified before the Talley device can be utilized—a cumbersome requirement. Furthermore, the entire device needs to be detached from the ladder in order to adjust the leveler.

Cordell's ladder leveling device is similar to Batten's device. Cordell teaches a ladder leveler attached to a ladder leg and with an adjustable inner leveler leg secured onto said leveler by a pin or pin-like means. Cordell like Batten is connected to only one side of the ladder leg and does not provide much support in case the ladder leans left or right.

Smith teaches a simple adjustable foot extension held close to a ladder leg. The leg extension, however, is relatively short and is therefore limited to leveling ladders on slight inclinations. Furthermore, the leg extension is fixed directly on a ladder, therefore, the entire device has to be manipulated in order to adjust the leg extension.

Easton and Erion also teach ladder levelers. Easton teaches a leveler device with an elongated side leg slidable within a U-shaped channel member connected to a ladder leg. The elongated side leg may be clamped onto the U-shaped channel member at a plurality of points. The Easton device, however, is not easily fixed onto a ladder being leveled nor easily disconnected from the ladder.

Erion teaches a ladder leveler device which surrounds a ladder leg, the ladder leg and leveler device have pin holes for the insertion of a pin in order to secure the device to the ladder leg. Thus, Erion teaches modification of a ladder before the ladder can be leveled by the leveling device. Furthermore, the Erion device is not easily adjustable, because the device needs to be detached from the ladder before adjusting.

Up to the point of this invention no ladder leveler device has been disclosed which is easily attached to and detached off a ladder, is secured onto the ladder without altering the ladder in any way, may be adjustable in length without removing the leveler device from the ladder, clips onto the rungs of a ladder, and provides resistance to a ladder leaning to the right or left.

Another problem with leveling ladders is how to avoid the foot of a ladder leg (if a ladder leg has a foot). Often the foot of a ladder is large and wide, therefore, ladder leveling devices extend away from a ladder to avoid the foot. No device hugs the face of the ladder leg and at the same time avoids or clears the foot.

SUMMARY OF THE INVENTION

A novel and improved apparatus for and method of leveling ladders is disclosed. The novel apparatus is secured onto a ladder leg by sliding underneath and around rungs of the ladder. The apparatus also includes a channel within which an intrack leg, with a pivotable foot on one end, slides; the intrack leg is locked in relation to the leveler by inserting a holding pin through the channel and the intrack leg. Furthermore, the novel apparatus includes two side walls with rung support cup means for sliding underneath and around rungs of a ladder; the side walls also provide resistance to the ladder leaning to the right or the left.

It is another object of the invention to disclose a novel and improved ladder leveler which is easily secured onto and removed from a ladder.

It is yet another object of the invention to disclose a novel and improved ladder leveler which may be secured onto an unmodified ladder.

It is yet another object of the invention to disclose a novel and improved ladder leveler which may be adjusted in length while the leveler is still attached to the ladder.

It is yet another object of the invention to disclose a novel and improved ladder leveler which provides resistance in case a leveled ladder leans to the left or to the right.

It is yet another object of the invention to disclose a novel method of leveling ladders.

Further objects of the invention will be set forth in the description which follows, and become apparent to those skilled in the art upon examination of the specifications or by practice of the invention.

BRIEF DESCRIPTION OF THE DRAWINGS

The Figure is a front angle perspective of the ladder leveler device built in accordance with the teachings of the present invention, with the ladder leveler slid onto a leg of a ladder, leveling the ladder set on an uneven surface.

DETAILED DESCRIPTION OF THE INVENTION

Figure 1:
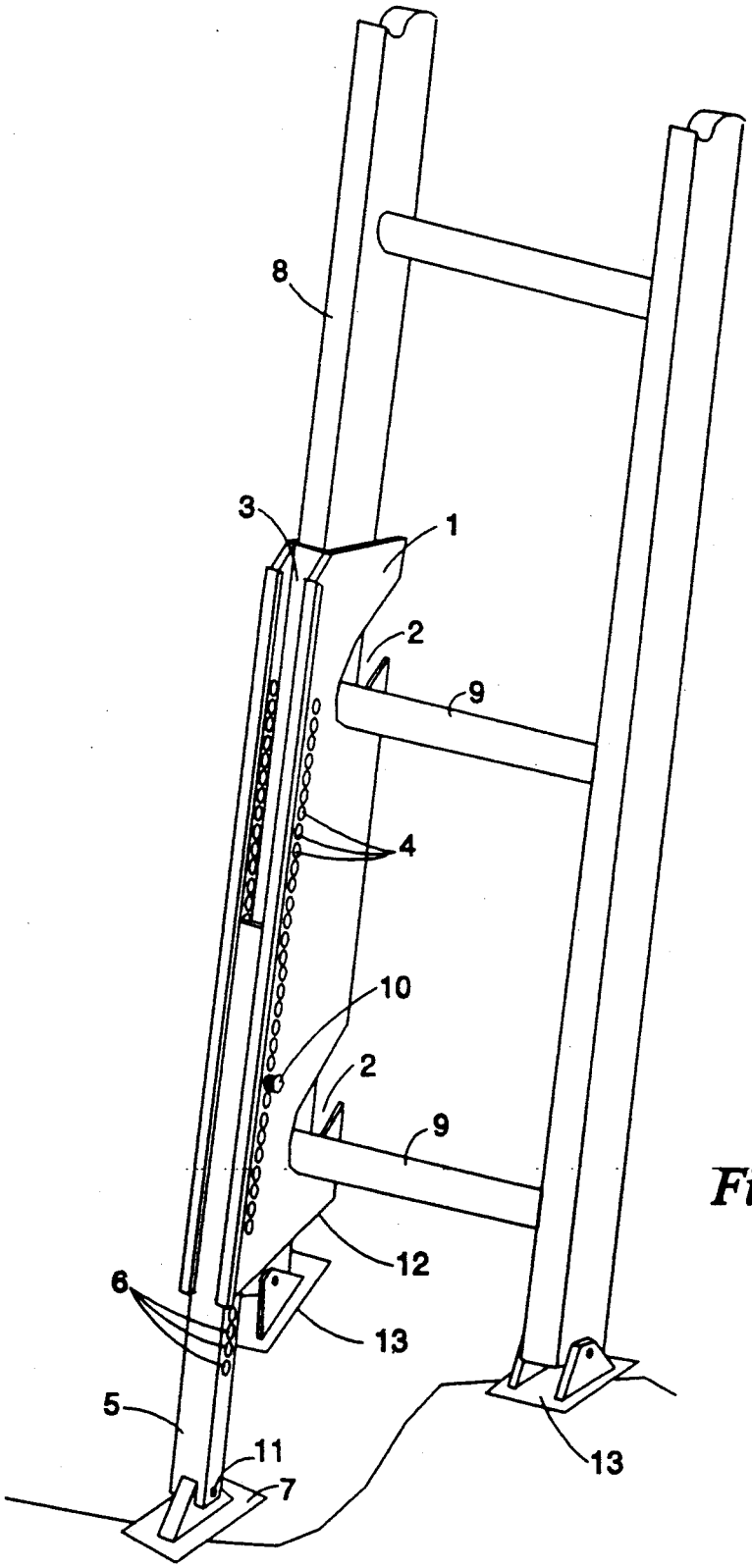

A ladder leveler device which attaches onto a ladder leg needing to be extended comprises the parts of: a. rung support cup means (2) (see FIG. 1), b. two matched side walls (1), each side wall having a pair of rung support cup means (2), the pairs of rung support cup means (2) are also matched, c. a channel sleeve (3), including pin holes (4) in said channel sleeve (3), d. an intrack leg (5), including intrack pin holes (6) in said intrack leg (5), e. a pivot pin (11), f. a pivotable foot (7), pivotally connected to the intrack leg (5) by the pivot pin (11), and g. a holding pin (10). Wherein, the side walls (1) are parallel to one another and are connected to the channel sleeve (3), thereby, creating in essence two sleeves back to back: a) a channel sleeve and, b) a sleeve for attaching onto a ladder leg, or in other words, a ladder leg sleeve. One rung support cup means (2) of one side wall slides underneath and around the bottom rung of the ladder, and the other rung support cup means (2) of the same side wall slides underneath and around the next to last rung of the ladder. The other side wall is not attached to the rungs (9), and is on the outside of the ladder leg (8) being extended (left of the left leg or right of the right leg of the ladder). The intrack leg (5) with intrack pin holes (6) slides in the channel sleeve (4), and is secured onto and held in fixed relationship to the channel sleeve (4) by inserting the holding pin (10) through an aligned intrack pin hole (6) and channel sleeve pin hole (4).

The distance between the rung support cup means (2) (see FIG. 1) of the side walls (1) varies according to the distance between rungs of a ladder. Because the distance between rungs in a many ladders is one foot, the distance between the rung support cup means (2) is one foot, as well. Furthermore, it is not beyond the scope of the invention to have side walls (2) with three or even four rung support cup means (2) in order to slide underneath and around additional rungs (9) of a ladder.

When the ladder leveler (see FIG. 1) is secured onto a ladder leg (8) needing to be extended, one side wall is on the left side of the ladder leg (8) and the other side wall is on the right side of the same ladder leg (8). One side wall is attached to rungs (9) of the ladder, and the other side wall is not attached to rungs (9). The two side walls (1) provide resistance in case the leveled ladder leans to the right of the left. The leveling device (see FIG. 1) in attached relation to the ladder and with a person standing on said ladder remains firmly attached to said ladder. The mass of the person and the mass of the ladder exert downward forces—forcing the engaged rungs (9) to remain snugly held by said rung support cup means (2). Furthermore, in the ladder leveler may be made of aluminum or any other material(s) with similar properties, including strength.

Another feature of the subject ladder leveler is a tapered cut (12) (see FIG. 1) on bottom of both side walls (1). The tapered cut (12) allows the ladder leveler to clear a pivotable foot (13) on a ladder leg (8) (if the ladder leg has a foot), so that the rung support cup means (2) may be slid onto the bottom rungs (9) of the ladder. Furthermore, if the pivotable foot (13) on the ladder leg (8) is large the tapered cut (12) allows the pivotable foot (13) to be cocked backward by the intrack leg (5) when said ladder leveler is secured onto said ladder.

The disclosed subject ladder leveler may be used by: a. sliding one rung support cup means (2) (see FIG. 1) of one side wall (1), underneath and around the bottom rung (9) of a ladder, and sliding the other rung support cup means (2) of the same side wall (1) underneath and around the next to bottom rung (9) on the ladder, b. sliding the intrack leg (5), including intrack pin holes (6), to a length needed to level said ladder, c. making certain the channel sleeve pin holes (4) and intrack pin holes (6) are aligned, and d. inserting the holding pin (10) through an aligned intrack pin hole (6) and channel sleeve pin hole (4) to hold the intrack leg (5) in position relative to said channel sleeve (3).

The disclosed subject ladder leveler is easily detached from a ladder. The ladder leveler device may be simply detached by drawing the ladder leveler (see FIG. 1) downward and then outward, thereby, disengaging the rung support cup means (2) from the rungs (9) of the ladder. Furthermore, the channel sleeve (3) (FIG. 1) may be open as in FIG. 1 or may be closed.

In other words, the disclosed subject ladder leveler could be described simply as a two sleeves attached in a back to back fashion; one sleeve, a ladder leg sleeve means (see FIG. 1) (corresponding to the side walls (1) and the back side of channel sleeve (3)), slides onto a ladder leg (8) needing to be extended, and the other sleeve, an extension piece sleeve means (corresponds to numeral 3), allows an extension piece (corresponds to numerals 5, 11, and 7) to slide within and be fixed to the extension piece sleeve means (corresponds to numeral 3). The ladder leg sleeve means (corresponding to numeral 1 and the back side of channel sleeve (3)) includes rung support cup means (2) which slide underneath and around the bottom rungs (9) of a ladder, in order to attach the ladder leg sleeve means (corresponding to numeral 1 and the back side of channel sleeve (3)) onto a leg (8) of a ladder needing to be leveled (extended). The extension piece sleeve means (3) is attached to said ladder leg sleeve means (corresponding to numeral 1 and the back side of channel sleeve (3)) in a back to back fashion, and the extension piece (5, 11, and 7) is slidable in the extension piece sleeve means (3) and is fixed onto the extension piece sleeve means (3) in order to level the ladder. The extension piece may be fixed to said extension piece sleeve means (3) by inserting a pin (10) through the extension piece sleeve means (3) and extension piece (5, 11, and 7). Insertion of the pin (10) may be made easier by including a set of pin holes (4) in the extension piece sleeve means (3) and a set of pin holes (6) in the extension piece (5, 11, and 7) and aligning these sets of pin holes (4 and 6) before insertion of the pin (10).

Furthermore, a tapered cut (12) on the bottom of both sides of said ladder leg sleeve means (corresponding to numeral 1 and the back side of channel sleeve (3)) allows the subject ladder leveler to clear a pivotable foot (13) on said ladder leg (8) when said rung support cup means (2) are slid underneath and around the bottom rungs (9) of said ladder. Furthermore, if the pivotable foot (13) on the ladder leg (8) is large the tapered cut (12) allows the pivotable foot (13) to be cocked backward by the extension piece (5, 11, and 7), when the ladder leg sleeve means (corresponding to the side walls (1) and the back side of channel sleeve (3)) is secured onto said ladder leg (8).

The ladder leg sleeve means (see FIG. 1) (corresponding to numeral 1 and the back side of channel sleeve (3)) provides resistance to said ladder leaning to the left or the right when said ladder leg sleeve means (corresponding to numeral 1 and the back side of channel sleeve (3)) is slid onto said ladder. Furthermore, the distance between said rung support cup means (2) is the same as the distance between rungs (9) of said ladder.

The foregoing description has been directed to particular embodiments of the invention in accordance with the requirements of the Patent Statutes for the purposes of illustration and explanation. It will become apparent, however, to those skilled in the art that many modifications and changes will be possible without departure from the scope and spirit of the invention. It is intended that the following claims be interpreted to embrace all such modifications.

We claim:

1. A ladder leveler device for attaching to a ladder comprising the parts of:

a. rung support cup means, b. two side walls, each side wall having at least a pair of rung support cup means, c. a channel sleeve means, including pin holes in said channel sleeve means, d. an intrack leg, including intrack pin holes in said intrack leg, e. a pivot pin, f. a pivotable foot, pivotally connected to the intrack leg by the pivot pin, and g. a holding pin; wherein, said side walls are parallel to each other and are connected to said channel sleeve means; one rung support cup means of one side wall slides underneath and around the bottom rung of said ladder, and the other rung support cup means of said same side wall slides underneath and around the next to bottom rung of said ladder; an intrack leg with intrack pin holes slides in said channel sleeve means, and is secured onto and held in fixed relationship to said channel sleeve means by inserting said holding pin through an aligned intrack pin hole and channel sleeve means pin hole.

2. The ladder leveler of claim 1 wherein the distance between said rung support cup means is the same as the distance between said rungs of said ladder.

3. The ladder leveler of claim 1 wherein on side wall is on the left side of a ladder leg of said ladder and the other side wall is on the right side of a leg of said ladder when said rung support cup means is slid onto said leg of said ladder.

4. The ladder leveler of claim 3 wherein said side walls provide resistance to said ladder leaning to the left or the right when said rung support cup means is slid onto said ladder.

5. The ladder leveler of claim 1 further comprising a tapered cut on the bottom of said side walls, used to clear a foot on a leg of said ladder when said rung support cup means are slid underneath and around said bottom rungs of said ladder.

6. The ladder leveler of claim 1 further comprising a tapered cut on the bottom of said side walls, which allows a pivotable foot on a leg of said ladder to be cocked backward by said intrack leg when said rung support cup means are slid underneath and around said bottom rungs of said ladder.

7. A combination comprising a ladder leveler and a ladder, said ladder leveler comprising the parts of: a. a ladder leg sleeve means, having rung support cup means and a tapered cut on the bottom of said sleeve, b. an extension piece means, and c. an extension piece sleeve means, attached to said ladder leg sleeve means in a back to back fashion; wherein said extension piece means slides in the extension piece sleeve mean and may be fixed to said extension piece sleeve means; said ladder comprising two parallel legs connected by and perpendicular to a plurality of parallel rungs, and said legs each having a foot; wherein, said ladder leg sleeve means is attached to a leg of said ladder needing to be extended, by said rung support cup means of said ladder leg sleeve means, sliding underneath and around the bottom rungs of said ladder; wherein said ladder leg sleeve means provides resistance to said ladder leaning to the left or the right when said ladder leg sleeve means is slid onto said ladder; and wherein said tapered cut on the bottom of said ladder leg sleeve means, is used to clear said foot on said ladder leg when said rung support cup means are slid underneath and around said bottom rungs of said ladder.

8. The combination of claim 7, wherein said foot of said leg of said ladder is pivotable.

9. The combination of claim 8, wherein said tapered cut on the bottom of said ladder leg sleeve means allows said pivotable foot on said ladder leg sleeve means to be cocked backwards by said extension piece when said ladder leg sleeve means is attached onto said ladder.

10. A method of leveling ladders comprising the steps of:

a. attaching a ladder leg sleeve means onto a leg of a ladder needing to be extended, by sliding rung support cup means of said ladder leg sleeve means underneath and around the bottom rungs of said ladder, b. simultaneously clearing a foot on said leg of said ladder with a tapered cut on the bottom of said ladder leg sleeve means, c. attaching an extension piece sleeve means to said ladder leg sleeve means in a back to back fashion, and d. fixing an extension piece sleeve means, slidable in an extension piece sleeve means, onto said extension piece sleeve means, in order to level said ladder.

* * * * *